US005408777A

United States Patent [19]

Brooks

[11] Patent Number: 5,408,777

[45] **Date of Patent: * Apr. 25, 1995**

[54] GRIP LOCK ASSEMBLY

[75] Inventor: Frank Brooks, Jupiter, Fla.

[73] Assignee: Saf-T-Lok Corporation, West Palm Beach, Fla.

[ * ] Notice: The portion of the term of this patent subsequent to Jul. 20, 2010 has been disclaimed.

[21] Appl. No.: 94,299

[22] Filed: Jul. 20, 1993

Related U.S. Application Data

[63] Continuation of Ser. No. 645,566, Jan. 24, 1991, Pat. No. 5,229,532, which is a continuation-in-part of Ser. No. 556,016, Jul. 20, 1990, Pat. No. 5,090,148, which is a continuation-in-part of Ser. No. 202,988, Jun. 6, 1988, Pat. No. 4,987,693.

[51] Int. Cl.[6] ..... F41A 17/00

[52] U.S. Cl. ..... 42/70.11; 42/66

[58] Field of Search ..... 42/70.11, 70.01, 70.08, 42/70.04, 66

[56] References Cited

U.S. PATENT DOCUMENTS

| | | | |
|---|---|---|---|
| 848,825 | 4/1907 | Allen | 42/66 |
| 2,803,910 | 8/1957 | Lyle | 42/70.01 |
| 2,994,981 | 8/1961 | Corrigan | 42/70.08 |
| 3,115,765 | 12/1963 | Fengler | 70/315 |
| 3,159,080 | 12/1964 | Freed | 42/70.01 |
| 3,199,240 | 8/1965 | Largen | 42/70.03 |
| 3,368,297 | 2/1968 | Lentz | 42/70.11 |
| 3,720,014 | 3/1973 | Goodrich | 42/70.11 |
| 3,722,238 | 3/1973 | Ring | 70/278 |
| 3,735,519 | 5/1973 | Fox | 42/70.05 |
| 3,768,189 | 10/1973 | Goodrich | 42/70.11 |
| 3,939,679 | 2/1976 | Barker et al. | 42/70.11 |
| 4,003,152 | 1/1977 | Barker et al. | 42/70.11 |
| 4,014,123 | 3/1977 | Williams | 42/70.11 |
| 4,084,341 | 4/1978 | Cervantes | 42/70.11 |
| 4,091,557 | 5/1978 | Murabito | 42/66 |
| 4,291,481 | 9/1981 | Hillberg | 42/70.02 |
| 4,302,898 | 12/1981 | LaRue | 42/70.11 |
| 4,457,091 | 7/1984 | Wallerstein | 42/70.11 |
| 4,488,370 | 12/1984 | Lemelson | 42/70.11 |
| 4,499,681 | 2/1985 | Bako et al. | 42/70.07 |
| 4,682,435 | 7/1987 | Heltzel | 42/70.11 |
| 4,763,431 | 8/1988 | Allan et al. | 42/70.11 |

OTHER PUBLICATIONS

Beretta dal 1526, Serie 81, Instructions for Operation, Sep. 1986.

Smith & Wesson Revolvers, Safety & Instruction Manual, Apr. 1987.

Smith & Wesson, Semiautomatic Centerfire Pistols, Safety, Instruction & Parts Manual, Jun. 1988.

*Primary Examiner*—David Brown

[57] ABSTRACT

A grip lock assembly for firearms includes a lock having a locked position preventing operation of the firearm, and an unlocked position permitting operation of the firearm. A portion of the lock, when in the locked position, is adapted to operatively engage a portion of the firing mechanism of the firearm to prevent operation of the firearm. The invention is quickly installed by replacing an existing grip of the firearm with grips according to the invention. The invention can be utilized with a number of different types of locks. A ratchet-type combination lock suitable for use with the invention is also disclosed.

6 Claims, 6 Drawing Sheets

GRIP LOCK ASSEMBLY

CROSS-REFERENCE TO RELATED APPLICATIONS

This application is a Continuation of Applicant's application Ser. No. 645,566, filed Jan. 24, 1991, now U.S. Pat. No. 5,229,532, which is a Continuation-in-Part of Applicant's application Ser. No. 556,016, filed Jul. 20, 1990, now U.S. Pat. No. 5,090,148, which is a Continuation-In-Part of Applicant's application Ser. No. 202,988, filed Jun. 6, 1988, now U.S. Patent No. 4,987,693.

BACKGROUND OF THE INVENTION

1. Field of the Invention

This invention relates generally to gun locks, and more particularly to gun locks which are provided so as to be substantially integral with the firearm.

2. Description of the Prior Art

There is a continuing concern about the prevalence of handguns and other firearms. One of the objections to firearms relates to the use of these weapons by unauthorized persons. Tragic accidents occur when children happen upon firearms, often in their own homes, and attempt to play with the firearms. The safety mechanisms that are found on firearms are not adequate to prevent injury, and curious children will often move the safety to the "off" position without knowledge of the significance of their actions. Most revolvers do not have a safety. A measure of safety can be obtained by removing the bullets from the weapon, but it is time consuming to load a weapon in an emergency situation and the danger exists that the gun will not be loaded when it is needed immediately.

Another alarming situation is encountered when unauthorized persons wrestle weapons from police officers or private citizens and turn them on the owner or others. The safety is only a slight impediment to firing the weapon, and at best gives the police officer or owner only an instant to retrieve the weapon.

Applicant has previously disclosed locks adapted to be integrally included with firearms and which are able to prevent unauthorized use of the firearm. These locks, as described in the above-referenced co-pending patent applications, contain portions which are adapted to operatively engage a portion of the firing mechanism of the firearm to prevent operation of the firearm. This portion of the lock is moved out of operative engagement with the firing mechanism when the lock is in the "unlocked" position, to permit operation of the firearm. Suitable exemplary lock configurations are described in the above-referenced co-pending patent applications, although many other types of locks are also suitable. Similarly, the manner in which the lock operatively engages the firing mechanism of the firearm can be varied. Applicant has previously disclosed constructions in which a locking bar moves into and out of operative engagement with an existing external safety mechanism of the weapon to alternatively prevent or permit movement of the existing safety to the "unsafe" position. In another embodiment, a pin is moved into and out of an obstructing position with respect to the path of the hammer of the firearm to respectively prevent or permit operation of the firearm.

There exists a continuing need to provide alternative lock configurations for the many firearms which currently are in existence. Particularly, there is a need to facilitate the installation of locks into existing firearms, and to simplify the operation of the lock to reduce manufacturing costs and to insure lock reliability.

SUMMARY OF THE INVENTION

It is an object of the invention to provide a firearm safety mechanism which will render the firearm inoperable to unauthorized users.

It is another object of the invention to provide a firearm safety mechanism which can be quickly activated or deactivated by an authorized user.

It is still another object of the invention to provide a firearm safety mechanism which is easily installed.

These and other objects are accomplished by a firearm safety mechanism in which a lock is integrally installed in a grip, including a stock, adapted to replace the existing grip of the firearm. A portion of the lock, when in a locked position, is adapted to operatively engage a portion of the firing mechanism of the firearm to prevent operation of the firearm. This portion of the lock, when in an unlocked position, is operatively disengaged from that portion of the firing mechanism to permit operation of the firearm.

The invention is particularly suited for use with existing safety features in the firearm. In one embodiment, the lock in the locked position is adapted to abut an existing external safety mechanism of the weapon to prevent movement of the external safety mechanism to the "unsafe" position. Movement of the lock to the unlocked position will permit movement of the safety to the "unsafe" position and operation of the firearm. The lock is positioned in the grip such that, upon installation in the firearm, a movable portion of the lock can be moved into and out of an abutting relationship with the existing external safety mechanism of the weapon.

In another embodiment, the lock is provided with a movable portion which, upon installation into a revolver, operatively abuts and engages the cylinder release. Many revolvers have a cylinder release thumb piece which must be operated to permit movement of the cylinder out of alignment with the barrel. The cylinder release in many revolvers is mechanically connected to prevent operation of the firearm when in the released position. An intermediate position of the cylinder release often exists in which operation of the firearm is prevented, yet the cylinder is not released. The cylinder release can be adjusted to this intermediate position between the unreleased and fully released positions, which will provide locking of the firing mechanism without releasing the cylinder. The lock is adapted such that movement to the locked position will cause movement of the cylinder release to the intermediate position and inactivation of the firearm.

The type of lock that is used can be selected from a number of suitable designs. A preferable lock design is a combination lock in which one or more push members such as buttons are provided. Each of the buttons must be depressed an appropriate number of times, corresponding to the combination of the lock, in order to unlock the lock and to permit operation of the firearm. The internal lock structure can also be varied. There is disclosed a lock comprising straight ratchet members which are moved by depression of corresponding push buttons and push rods connected to the push buttons. The push buttons and corresponding push rods are adapted to move the associated ratchet members against spring biasing and through a distance approximately corresponding to the distance between ratchet teeth on the ratchet member. A catch such as a ratchet pawl engages the ratchet teeth to prevent the return of the ratchet member upon the release of the push button. Each ratchet member has an associated locking channel or protrusion. The locking channel or protrusion must be moved into alignment with corresponding locking channels or protrusions located on a slide member in order to permit movement of the slide member and movable lock portion to the "unlocked" position. Structure is provided for resetting the ratchet members when the slide has been returned to the "locked" position.

BRIEF DESCRIPTION OF THE DRAWINGS

There is shown in the drawings embodiments which are presently preferred, it being understood, however, that: the invention is not limited to the precise arrangements and instrumentalities shown, wherein.

DETAILED DESCRIPTION OF THE PREFERRED EMBODIMENTS

Figure 1:
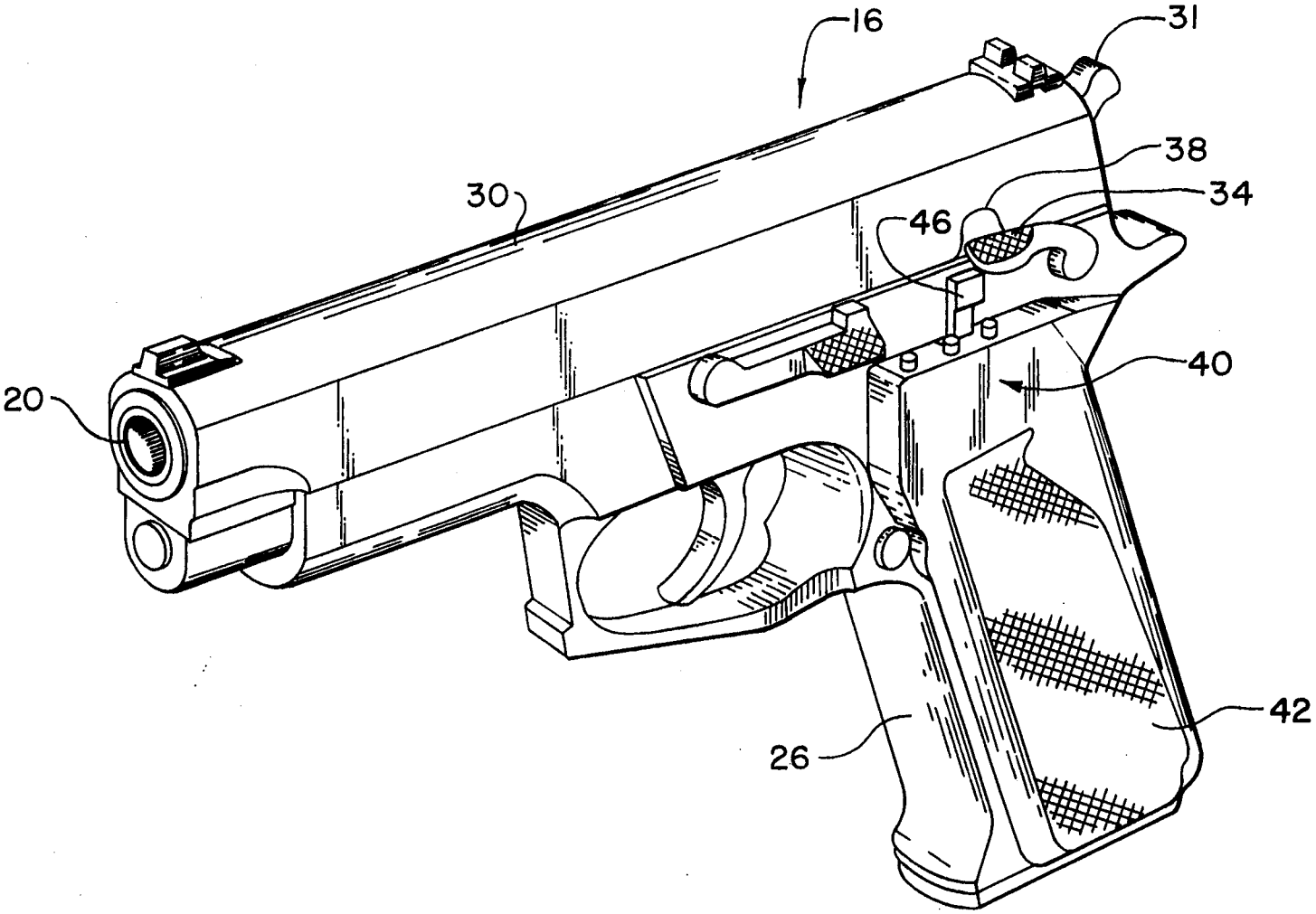
FIG. 1 is a perspective view of a grip lock assembly according to the invention.

The safety mechanism of the invention can be used, with minor modification, in gun designs of many descriptions. The operation of most handguns is well understood, and described in several volumes including the Gun Digest Book of Firearms Assembly/Disassembly, Parts I and II; Automatic Pistols and Revolvers, by J. B. Wood, D.B.I. Books, Inc., Northbrook, Ill., 1979; The S&W Revolver, A Shop Manual, Jerry Kuhnhavsen, V.S.P. Publishers, Department 1A, Box 1966, Tusten, Calif. 92681; The Colt 45 Automatic, A Shop Manual, Jerry Kuhnhavsen, V.S.P. Publishers, Department 1A, Box 1966, Tusten, Calif. 92681; and the NRA Guide to Firearms Assembly, National Rifle Association of America, 1600 Rhode Island Avenue N.W., Washington, D.C. 20036. The disclosures of the above-identified references are herein fully incorporated by reference. The invention can be utilized with automatic firearms such as the Beretta model 84BB, manufactured by the Fabbrica d'ArmiPietro Beretta S.P.A. of Via Pietro Beretta, 18-25063 Gardone Val Trompia, Brescia, Italy. The weapon is fully described in the Owner's Manual Beretta dal 1526, Series 81, distributed by the company, which manual hereby is fully incorporated by reference. The invention can also be utilized with the Smith & Wesson semiautomatic centerfire pistols, manufactured by the Smith & Wesson Company of 2100 Roosevelt Avenue, Springfield, Mass. The weapons are fully described in the Safety Instruction & Parts Manual, distributed by the company, which manual is hereby fully incorporated by reference.

There are shown in the drawings a grip lock assembly according to the invention in which a lock is operatively incorporated into a handle grip for the firearm. The lock may easily be installed into an automatic firearm by replacing the existing grip of the firearm with a grip according to the invention. The automatic handgun 16 depicted in FIGS. 1–4 includes a barrel 20, handle frame 26, and slide 30, and hammer 31. An existing external safety mechanism 34 is adapted for upward movement into slots 38 formed in the slide 30 to prevent rearward movement of the slide 30 and cocking of the hammer 31, and thus operation of the firearm. The safety 34 can be moved downward out of the slots 38 to permit rearward movement of the slide 30 and operation of the firearm.

According to the invention, a lock 40 is provided in a handle grip 42 that is adapted for installation into the firearm 16. The lock 40 includes structure for engaging a portion of the firing mechanism of the firearm 16 so as to, in a locked position, prevent operation of the firearm. The portion of the firing mechanism which can be engaged can be varied depending on the type and style of the firearm. In an embodiment suitable for use with automatic firearms such as the firearm 16, the lock 40 can be designed to work with the existing external safety mechanism 34 of the firearm. The lock 40 includes a lock portion such as the locking bar 46 which is movable to a position immediately beneath the safety 34.

The lock 40 can be selected from many different types of locks, including key locks, dialed combination locks, and the like. It is preferable, however, to provide a combination lock which is opened by entering the appropriate combination in one or more push members such as buttons. In this manner, external devices such as keys which are susceptible to loss are not necessary, and the combination can be entered in dark environments by simply sensing the location of the respective push buttons and entering the appropriate combination. Suitable lock constructions are disclosed in Applicant's application Ser. No. 202,988, filed Jun. 6, 1988, now U.S. Pat. No. 4,987,693, and application Ser. No. 556,016, filed Jul. 20, 1990, and Applicant's co-pending application entitled, DRAW BAR FIREARM LOCK, filed concurrently herewith. The disclosures of these applications and patents are hereby incorporated fully by reference.

Figure 2:
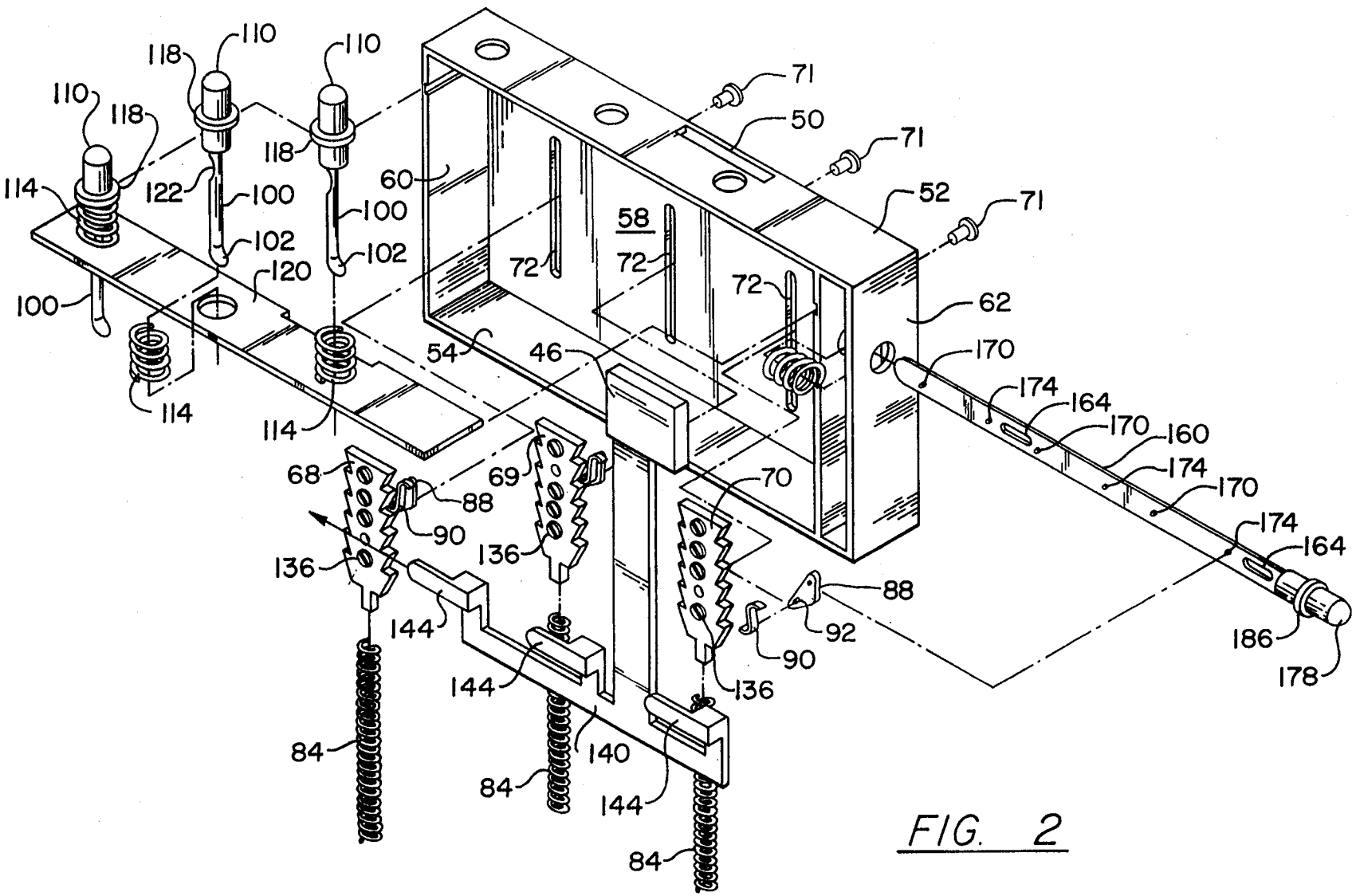
FIG. 2 is an exploded perspective of a suitable lock construction.
Figure 3:
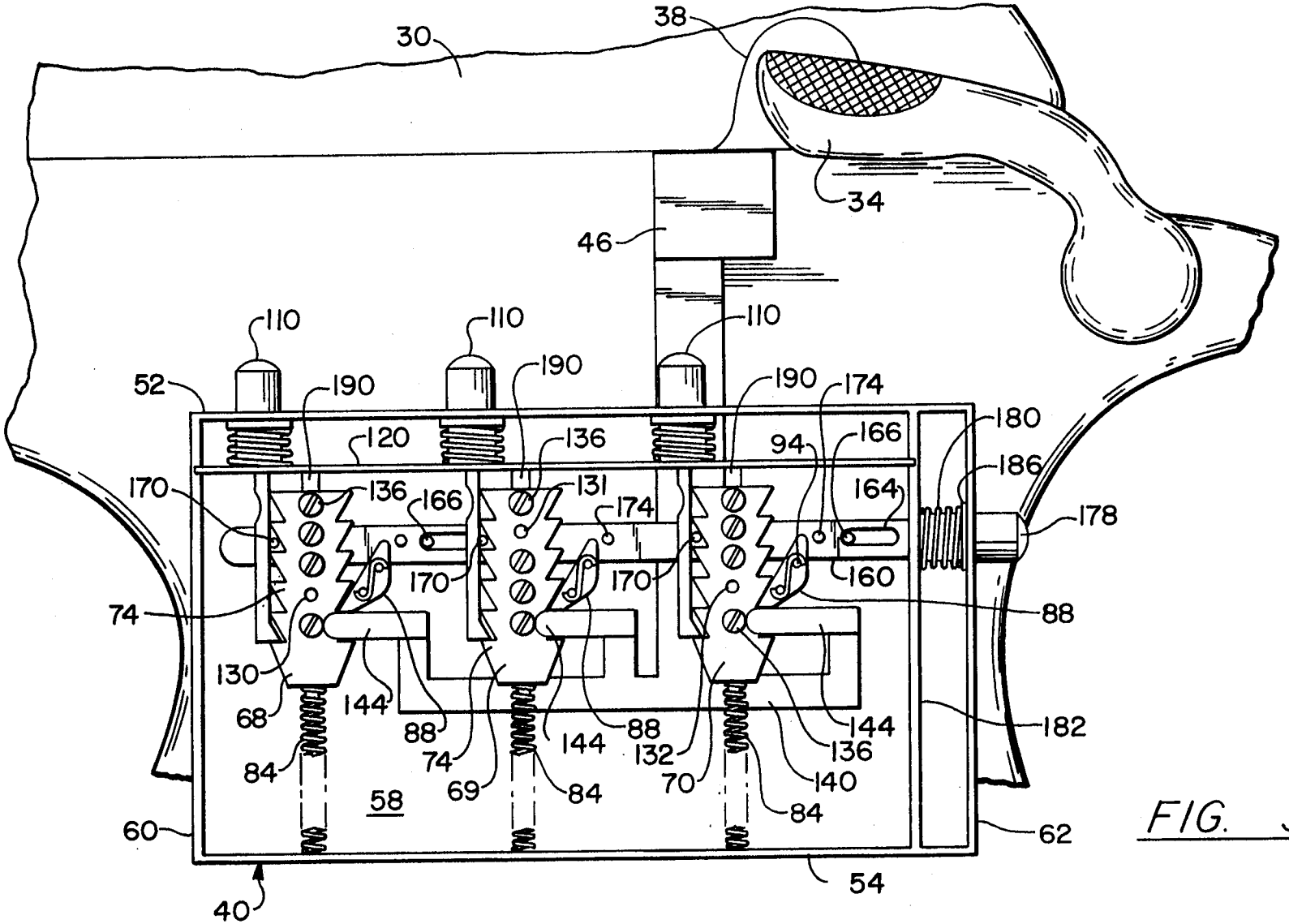
FIG. 3 is a front elevation of the lock construction of FIG. 2 as installed, the surrounding portions of the handle grip being removed to depict internal features, the lock being in a first, "locked" mode of operation.
Figure 4:
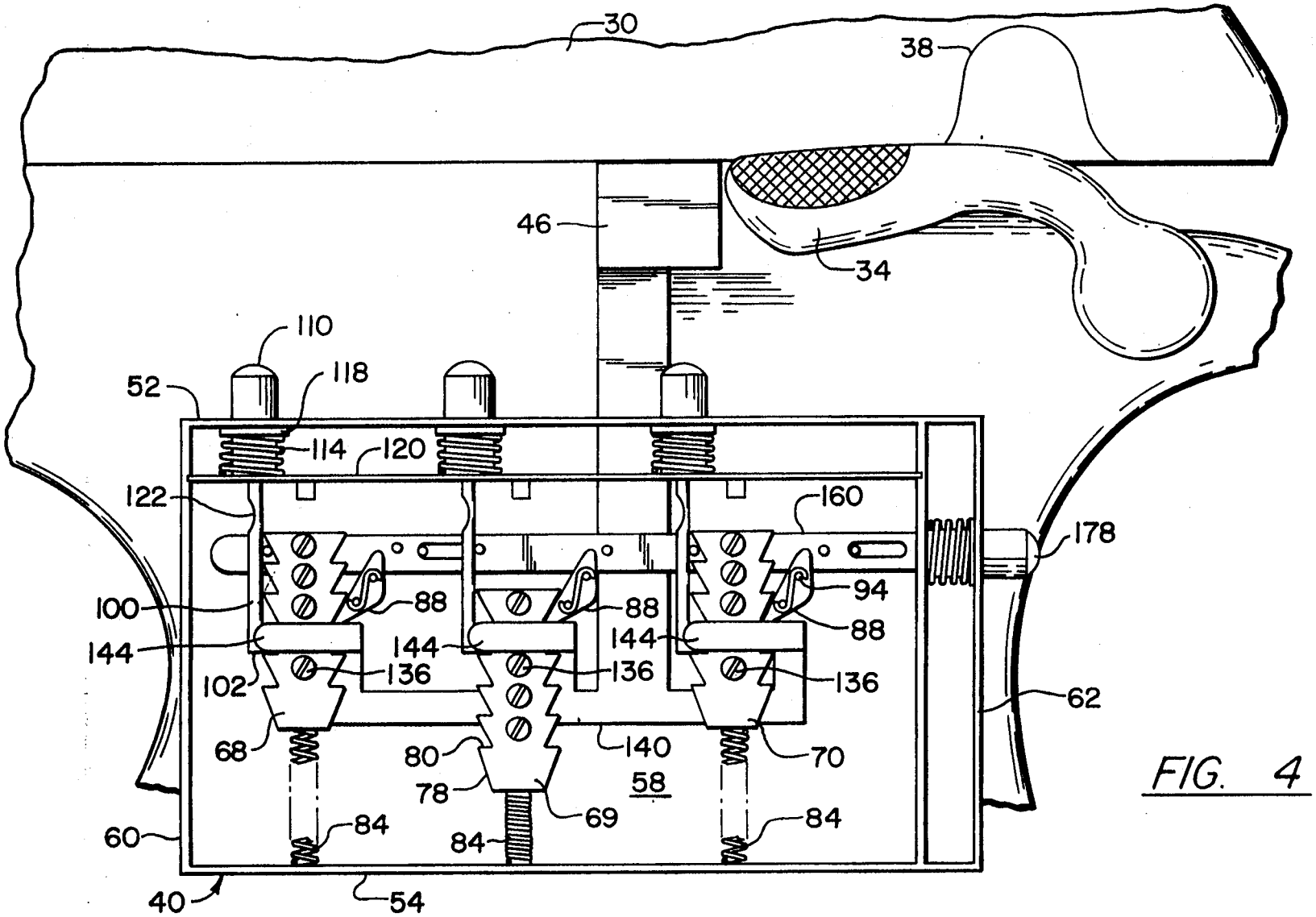
FIG. 4 is a side elevation similar to that of FIG. 3, and depicting the lock in a second, "unlocked" mode of operation.

An alternative embodiment of a suitable lock construction is shown particularly in FIGS. 2–4. The locking bar 46 can be extended through a slot 50 in a lock housing. In a first position, the locking bar 46 is beneath the safety 34 of the handgun 16 (FIG. 3). The locking bar 46 will prevent movement of the safety 34 out of the groove 38 to the "unsafe" position. Entering the proper combination into the lock 40, however, will permit the locking bar 46 to be moved to an unlocked position (FIG. 4) away from abutment with the safety 34. The safety 34 can be manipulated between the "safe" and "unsafe" positions in the usual manner when the lock 40 is in the unlocked position, and the firearm can be operated to move the slide 30 rearward and cock the hammer 31.

The lock 40 can include a housing which can be mounted directly to an exterior surface of the handgun 16 directly below the safety 34, however, it is presently preferred that the lock be mounted directly in the handle grip 42 as shown. The lock can be provided with a complete lock housing having a front face formed by the handle grip 42, a top face 52, a bottom face 54, a back face 58, and side faces 60, 62. At least one ratchet member, and preferably three elongated ratchet members 68–70 as shown, are movably mounted by pins 71 which extend through slots 72 in the housing to slidably engage the ratchet members 68–70 to the housing. Each of the ratchet members can have a plurality of substantially aligned ratchet teeth 74 which have a ramp surface 78 which slopes outwardly from the long axis of the ratchet member. The ramp surface 78 terminates in a substantially planar notch surface 80 (FIG. 4). Biasing as by springs 84 is provided to move each ratchet member substantially along the long axis of the ratchet member.

Catch members such as pawl members 88 are provided to engage the notch surfaces 80 to prevent further movement under the bias of the springs 84. The pawls 88 are biased into a position of engagement with the teeth 74 by suitable biasing means such as the leaf spring 90. The leaf spring 90 can engage a mounting pin 92 at an end of the pawl 88, and a pivotal mounting shaft 94 that is fixed to the back plate 58 and to which the pawl 88 is pivotally mounted.

Movement of the ratchet members 68–70 can be accomplished by a push rod 100 having at one end a foot 102 adapted to engage the teeth 74. The push rod 100 is tangentially aligned with the ratchet members 68–70 in such a manner that axial movement of the push rod will engage the foot 102 with the notch surface 80 of the ratchet teeth 74 to move the ratchet member substantially along its long axis. A button head 110 or other push member is fixed to an end of the push rod 100 opposite the foot 102 and extends through the top plate 52 of the housing to allow for manipulation by the user.

The throw of the push rod 100 is at least equal to the length of one of the ratchet teeth 74. Movement of the ratchet member will cause the pawl 88 to travel over the ramp surface 78 against the bias of the leaf spring 90 and subsequently to engage the notch surface 80 of the next succeeding tooth 74. The push rod 100 can be biased toward its original position by suitable means such as a coil spring 114, which is disposed between a flange 118 on the button 110 and an inside surface 120 of the housing. When pressure on the button head 110 is relaxed, the spring 114 will return the push rod 100 to the original position. The push rod 100 can have a thinned portion 122 which permits the push rod 100 to spring outward over the ramp surface 78 of the succeeding tooth as the ratchet member moves. The push rod 100 will spring inward as it passes the notch surface 80 of the succeeding tooth, and will be positioned for another throw. The ratchet member is thereby incrementally moved by the discreet operations of the push rod 100.

The combination required to open the lock can be determined by the position of protrusion-receiving lock channels. These channels can be formed in the ratchet members by several suitable configurations. In a preferred configuration, removable stop members such as screws 136 are secured into suitable apertures formed in each of the sprocket members 68–70. The locking bar 46 is engaged to a slide bolt 140. The slide bolt 140 includes locking protrusions 144, one of which is positioned adjacent to each ratchet member 68–70. The protrusions 144 are substantially parallel with the surface of each of the ratchet members 68–70, and are oriented so as to be substantially transverse to the long axis of each ratchet member. The screws 136 extend for a distance from the surface of each of the ratchet members 68–70, such that transverse movement of the projections 144 across the ratchet members 68–70, and therefore also movement of the slide bolt 140 and the locking bar 46, will be prevented when in the locked position (FIG. 3). Absence of screws, as from the threaded apertures 130–132, will create protrusion-receiving lock channels which will receive the protrusions 144 and permit movement of the slide bolt 140 and locking bar 46.

Operation of the push rods 100 will move the ratchet members in increments corresponding to the teeth 74. A given number of discreet movements of the push rods 100 by the buttons 110, equivalent to the combination, will align the channels corresponding to the apertures 130–132 with the protrusions 144. The left-hand ratchet member in FIG. 3 will require one movement for alignment to occur, the center ratchet member 69 will require four, and the right-hand ratchet member 70 will require one. When each of the buttons 110 have been depressed the proper number of times, all the channels will be aligned with the protrusions 144. The protrusions 144 can then slide into the channels (FIG. 4) with corresponding movement of the slide bolt 140. The locking bar 46 can then be moved from beneath the safety 34, whereupon the safety 34 can be operated in the usual manner. It will be readily appreciated that the combination may be easily changed by removing one of the screws 136 on a ratchet member and placing it into a presently unfilled aperture. This will close the prior receiving channel and create a new channel corresponding to a different combination.

It is desirable for the present embodiment that the operator be able to repeatedly initialize the ratchet members to the same starting position relative to the push rods 100. The operator may inadvertently enter the wrong number into the device, or may lose count of the number that has been entered. The combination must be reentered. The operator may start over by returning the ratchet members to a "0" position and repeating the process of entering the combination. This can be accomplished by provision of structure adapted to move the pawls 88 and push rods 100 from engagement with the teeth 74 so that the ratchet members 68–70 can move under the bias of the springs 84. An elongated reset arm 160 can be slidably mounted within the housing in an adjacent alignment with the push rods 100 and the pawls 88. The reset arm 160 can have slots 164 which can be axially aligned with the long axis of the reset arm 160. Pins 166 can be fixed to the back face 58 of the housing and slidably mount in the slots 164. The reset arm 160 can then slide past the mounting pins 166 and relative to the pawls 88 and push rods 100.

A plurality of push rod cam pins 170 are fixed to the reset arm 160 so as to be substantially adjacent to the push rods 100. A plurality of pawl member cam pins 174 are fixed to the reset arm 160 so as to be substantially adjacent to the pawls 88. The push rod cam pins 170 and pawl cam pins 174 extend outwardly from the reset arm 160 such that they contact the push rods 100 and the pawls 88 when the reset arm 160 is moved axially through the housing.

The reset arm 160 extends through the side face 62 of the housing, and can be fitted with a button 178 for manipulation by the user. A spring 180 is disposed between a seat 182 in the housing and flange 186 on the button 178. The spring 180 is adapted to bias the reset arm 160 to a position wherein push rod cam pins 170 and the pawl cam pins 174 are substantially removed from contact with the push rods 100 and the pawls 88, respectively, or to the right in FIG. 3.

The reset function is performed by depressing the reset button 178. This moves the push rod cam pins 170 and pawl cam pins 174 into contact with the push rods 100 and pawls 88, respectively. The push rods 100 are moved by the cam pins 170 to the left in FIG. 3 and the pawls 88 are pivoted by the motion of the cam pins 174, to a position out of contact with the ratchet teeth 74. The ratchet members 68–70 can then move under the bias of the springs 84 to the starting position (FIG. 3). Movement of the ratchet members is halted by stop surfaces 190 which project downwardly from the inside surface 120 of the housing. The ratchet members 68–70 will then be moved to the locked, starting position each time the reset button 178 is depressed. The operator may then re-enter the combination when operation of the firearm is desired.

The lock described in the above embodiments of the invention require the user to enter the combination selection in the form of a predetermined number of discrete depressions of each button. Other combination selections are contemplated. For example, the combination could require the user to depress a plurality of buttons in a proper sequential order. Other types of lock mechanisms are also known in the art, and are within the scope of the present invention. The lock described can also have utility as a lock for items other than firearms, such as suitcases, briefcases, and jewelry boxes.

Figure 5:
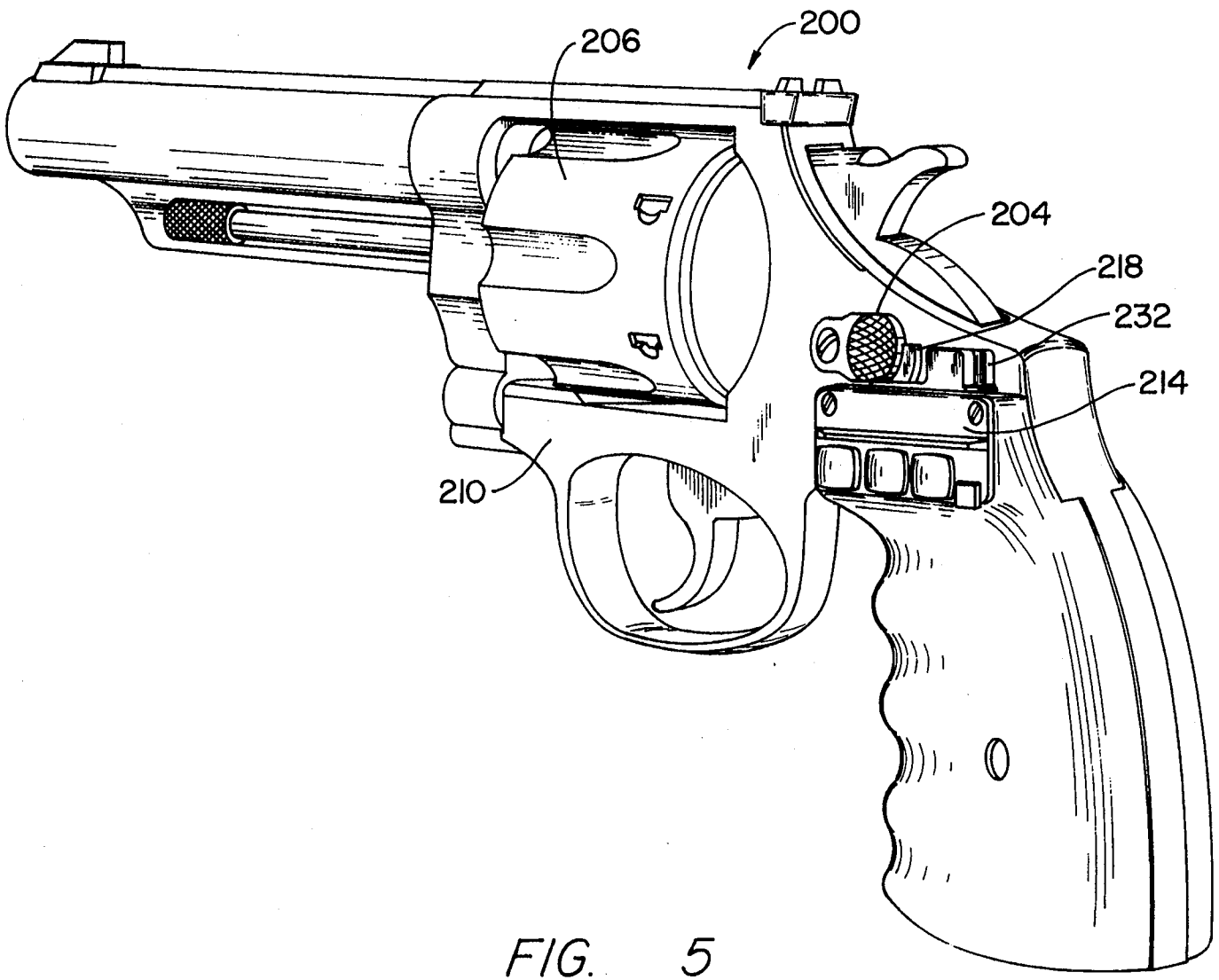
FIG. 5 is a perspective view of an alternative embodiment of the invention as installed in a revolver.
Figure 6:
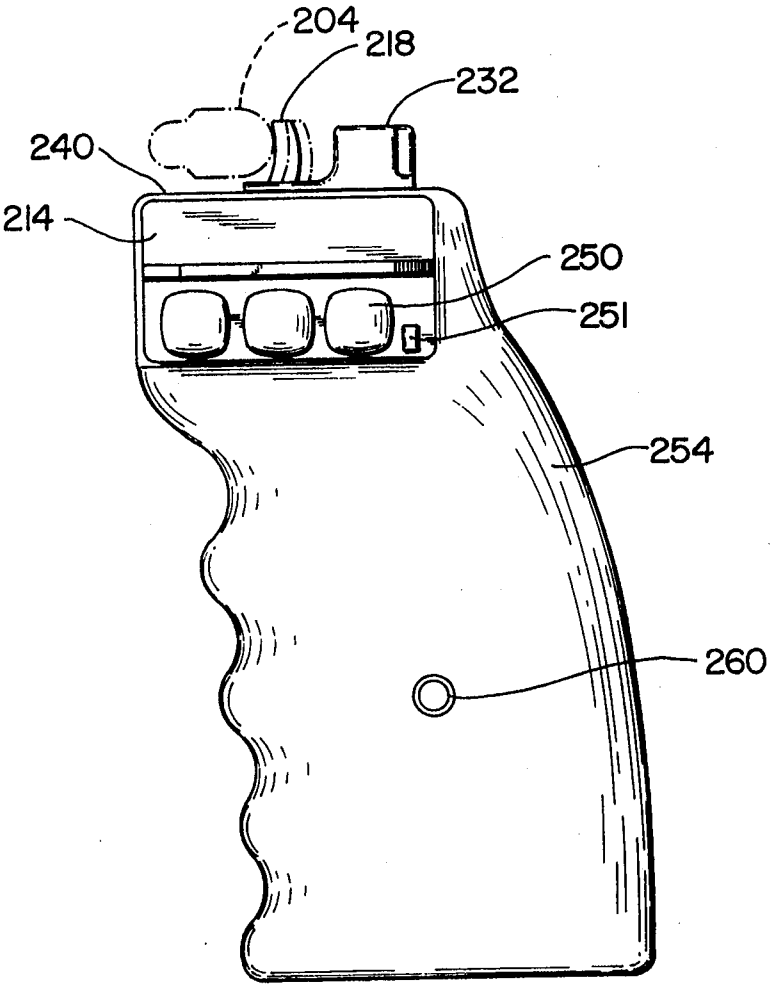
FIG. 6 is a front elevation of the gun grip of FIG. 5.
Figure 7:
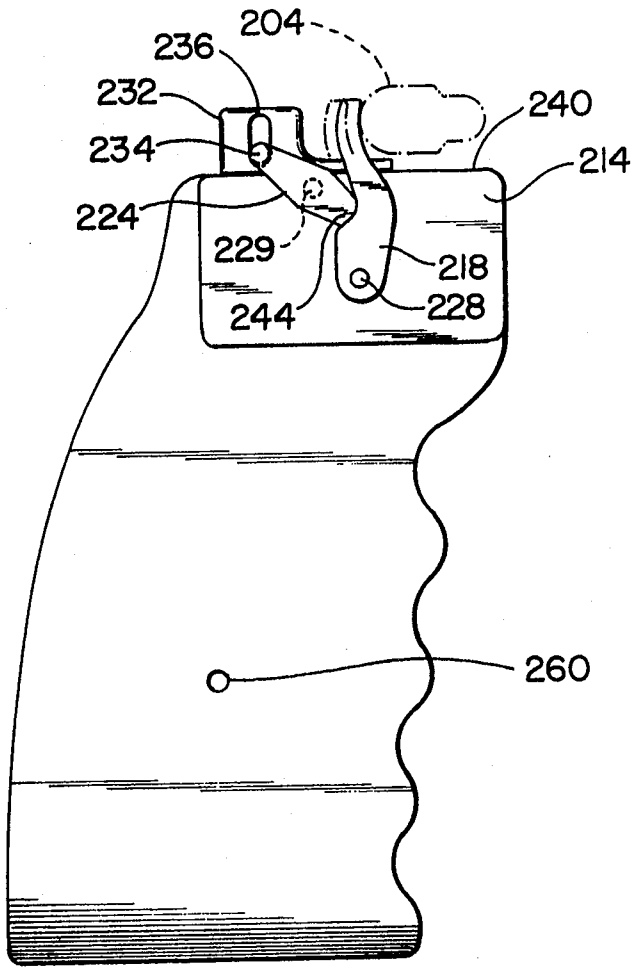
FIG. 7 is a rear elevation.

The invention can also be adapted for use with a variety of other types of firearms, including revolvers. An embodiment is depicted schematically in FIGS. 5–7 for a revolver 200 such as that manufactured by the Smith & Wesson Company of 2100 Roosevelt Avenue, Springfield, Mass., and described in the Safety & Instruction Manual Revolvers, 1987 and distributed by the company, the disclosure of which is hereby incorporated by reference. Such firearms do not include an external safety mechanism. Many such weapons do include a cylinder release 204, which operates to permit the removal of the cylinder 206 from the frame 210 of the firearm. The cylinder release usually is operated by sliding the release along the surface of the frame 210. Through mechanisms known in the art, such movement will not only release the cylinder 206 but will also prevent operation of the firearm. In many revolvers, slight movement of the cylinder release 204 to an intermediate position, perhaps fifty thousandths of an inch from the starting position, will prevent operation of the firearm yet will not release the cylinder 206. The invention takes advantage of the intermediate position of the cylinder release 204 by the provision of lock structure which, in the locked position, will lock the cylinder release 204 in this intermediate position. This will prevent operation of the firearm, yet will not release the cylinder 206.

According to this embodiment, a cylinder release engagement member is provided with a lock 214 such that, in the locked position, the cylinder release 204 will be moved to the released position and most preferably to the intermediate position where operation of the firearm will be prevented. In the unlocked position, the cylinder release engagement member will permit the cylinder release to return under its own biasing to a position where operation of the firearm is permitted.

In a presently preferred embodiment, advantage is taken of leverage to facilitate movement of the cylinder release 204 to the intermediate position. A cylinder release engagement member 218 is pivotally mounted to the lock 214 about a pivotal mounting 228. A lever member 224 is pivotally mounted to the lock 214 about a pivot member 229 and is substantially adjacent to the cylinder release engagement member 218. The lever member 224 is also pivotally mounted to a lock member 232 which is operatively connected to the slide bolt of the lock. An end 234 of the lever member 224 can be slidably mounted within a slot 236 in the lock member 232 to permit upward movement relative to the lock member 232. The lock member 232 is slidable along a top surface 240 of the lock 214 between locked and unlocked positions. Movement of the lock member 232 to the right in FIG. 6 will cause the lever member 224 to pivot about the pivot member 229 and will cause a lower surface 244 of the lever member 224 to engage and rotate the cylinder release engagement member 218 about the pivot member 228. This will cause the cylinder release engagement member 218 to move from the position shown in phantom lines to the position shown in solid lines, and correspondingly will move the cylinder release 204 to the intermediate position. This will prevent operation of the firearm. Upon unlocking the lock, biasing means within the lock can be provided to automatically return the lock member 232 to the unlocked position and movement of the cylinder release engagement member 218 to the position shown in phantom lines. This will permit the cylinder release 204 to return under its own biasing to the original position permitting operation of the firearm.

The lock 214 can be selected from a number of locks suitable for this purpose, including the lock disclosed herein and in Applicant's other co-pending applications. Still other locks could also be used. Push members 250 can be provided and depressed a proper number of times or in a proper sequence to unlock the lock 214. A reset button 251 can be provided to initialize the lock for re-entering the combination. Also, the lock 214 can be conveniently provided in a handle grip 254 which is adapted to replace the existing handle grips of the firearm. This will facilitate the installation of the lock on the firearm. A secure screw such as the butterfly screw 260 can be utilized to secure the handle grip 254 and lock 214 in place, and to resist removal by unauthorized users.

This invention can be embodied in several forms without departing from the spirit or essential attributes thereof, and accordingly, reference should be made to the following claims, rather than to the foregoing specification, as indicating the scope of the invention.

I claim:

1. A lock for firearms, comprising:

a lock housing;

a moveable lock portion adapted for positioning substantially adjacent a safety mechanism of the firearm having "safe" and "unsafe" positions, said lock portion having a locked position substantially preventing movement of the safety from the "safe" to the "unsafe" positions, and having an unlocked position substantially permitting normal operation of the safety;

said lock portion being connected to a slide bolt, a portion of the slide bolt being mounted substantially adjacent at least one elongated ratchet member, each ratchet member having a biasing member associated therewith and adapted to urge the ratchet member to an initial position;

a push member extending through the housing and adapted to move the ratchet member against the biasing of the biasing member;

a catch member adapted to engage the ratchet member following movement of the push member to prevent the return of the ratchet member to the initial position; and, corresponding locking channel and protrusion portions on the ratchet members and the slide bolt, movement of the ratchet member by the push member a distance corresponding to a lock combination being required to align the protrusions with the channels to permit movement of the protrusions into the channels and movement of the slide bolt and the lock portion.

2. The lock for firearms of claim 1, further comprising reset means for returning said ratchet members to the initial position.

3. The lock for firearms of claim 2, where said reset means comprises a reset arm adapted to move said catch members out of engagement with the ratchet members to permit the return of the ratchet members to the initial position upon the biasing of the biasing member.

4. The lock for firearms of claim 1, wherein said channels are formed on said ratchet members and said protrusions on formed on said slide bolt.

5. The lock for firearms of claim 4, wherein said channels are formed by detachable channel members.

6. The lock for firearms of claim 5, wherein the removable channel members are screws that are threadably received in corresponding openings in said ratchet members.

* * * * *